US008568187B2

(12) United States Patent
Norman

(10) Patent No.: US 8,568,187 B2
(45) Date of Patent: Oct. 29, 2013

(54) CONSTRUCTION SET

(75) Inventor: Philip Norman, Tarn (FR)

(73) Assignee: Robosynthesis Limited (GB)

( * ) Notice: Subject to any disclaimer, the term of this patent is extended or adjusted under 35 U.S.C. 154(b) by 722 days.

(21) Appl. No.: 12/525,150

(22) PCT Filed: Feb. 1, 2007

(86) PCT No.: PCT/FR2007/050733

§ 371 (c)(1),
(2), (4) Date: Jan. 11, 2010

(87) PCT Pub. No.: WO2008/093028

PCT Pub. Date: Aug. 7, 2008

(65) Prior Publication Data

US 2010/0144235 A1 Jun. 10, 2010

(51) Int. Cl.
*A63H 33/04* (2006.01)

(52) U.S. Cl.
USPC ..... 446/85; 446/487; 446/102; 446/124; 273/156; 52/585.1

(58) Field of Classification Search
USPC ..... 446/102, 124, 126, 476, 487, 118, 85, 446/105, 108; 273/156; 52/582.1
See application file for complete search history.

(56) References Cited

U.S. PATENT DOCUMENTS

| | | | | | |
|---|---|---|---|---|---|
| 1,240,807 | A | * | 9/1917 | Angus et al. | 446/108 |
| 2,610,856 | A | * | 9/1952 | Welty | 273/160 |
| 3,085,963 | A | * | 4/1963 | Martin | 376/459 |
| 3,233,358 | A | * | 2/1966 | Dehm | 446/102 |
| 3,638,352 | A | * | 2/1972 | Christiansen | 446/120 |
| 3,640,017 | A | * | 2/1972 | Christiansen | 446/102 |
| 4,164,091 | A | * | 8/1979 | Lin | 446/118 |
| 4,305,221 | A | * | 12/1981 | Chatani | 446/121 |
| 4,357,016 | A | * | 11/1982 | Allison | 273/156 |
| RE32,663 | E | * | 5/1988 | Atkinson | 405/19 |
| 4,758,196 | A | * | 7/1988 | Wang | 446/104 |
| 4,764,144 | A | * | 8/1988 | Lyman | 446/128 |
| 4,895,543 | A | * | 1/1990 | Vermette | 446/105 |
| D307,774 | S | * | 5/1990 | Bertrand | D21/500 |
| 5,094,643 | A | * | 3/1992 | Bolli et al. | 446/121 |
| D336,120 | S | * | 6/1993 | Knudsen | D21/500 |
| 5,259,803 | A | * | 11/1993 | Lyman | 446/103 |
| 5,322,466 | A | * | 6/1994 | Bolli et al. | 446/121 |
| 5,411,428 | A | * | 5/1995 | Orii et al. | 446/90 |
| 5,661,941 | A | * | 9/1997 | Vataker | 52/604 |
| 5,704,186 | A | | 1/1998 | Alcalay et al. | |
| 5,795,210 | A | * | 8/1998 | Kushner et al. | 446/128 |

(Continued)

FOREIGN PATENT DOCUMENTS

| | | |
|---|---|---|
| EP | 1022040 | 7/2000 |
| FR | 053796 | 7/2005 |
| WO | 9322018 | 11/1993 |

*Primary Examiner* — Gene Kim
*Assistant Examiner* — Urszula M Cegielnik
(74) *Attorney, Agent, or Firm* — Hartman Global IP Law; Gary M. Hartman; Domenica N. S. Hartman

(57) ABSTRACT

The invention relates to a construction set made of a plurality of different members interacting together for assembly, characterized in that one so-called connector member (100) among said members has an essentially cylindrical body with a cylindrical surface (110) that is preformed in order to interact for assembly with the correspondingly preformed bases (120, 130) of other connector members (100). The construction set includes a plurality of other constitutive members.

25 Claims, 18 Drawing Sheets

(56) References Cited

U.S. PATENT DOCUMENTS

| | | | | | |
|---|---|---|---|---|---|
| 5,839,938 | A * | 11/1998 | Manthei et al. | 446/120 |
| 5,853,314 | A * | 12/1998 | Bora | 446/120 |
| 5,954,562 | A * | 9/1999 | Chen | 446/118 |
| 6,030,270 | A * | 2/2000 | Krog | 446/102 |
| 6,073,404 | A * | 6/2000 | Norfleet | 52/236.3 |
| 6,086,444 | A * | 7/2000 | Glickman | 446/124 |
| 6,568,143 | B2 * | 5/2003 | Coleman | 52/604 |
| 6,572,436 | B1 * | 6/2003 | So | 446/478 |
| 6,595,825 | B1 * | 7/2003 | De Wilde | 446/102 |
| 6,641,453 | B1 * | 11/2003 | Morales et al. | 446/126 |
| 6,672,931 | B1 * | 1/2004 | Bagley | 446/125 |
| 6,752,381 | B2 * | 6/2004 | Colak et al. | 254/88 |
| 6,814,946 | B1 * | 11/2004 | Peddicord et al. | 422/275 |
| 7,025,351 | B2 * | 4/2006 | Christensen | 273/156 |
| 7,086,341 | B2 * | 8/2006 | Peddicord | 108/180 |
| 7,416,166 | B1 * | 8/2008 | Shaw | 254/88 |
| 7,553,209 | B1 * | 6/2009 | Sorensen | 446/124 |
| 7,648,407 | B1 * | 1/2010 | Sorensen | 446/120 |
| 7,736,211 | B2 * | 6/2010 | Marzetta | 446/122 |
| 7,980,912 | B2 * | 7/2011 | Shoptaugh | 446/85 |
| 8,002,241 | B1 * | 8/2011 | Shaw | 254/88 |
| 8,105,128 | B1 * | 1/2012 | Sorensen et al. | 446/128 |
| 2005/0106989 | A1 | 5/2005 | Rincover | |

* cited by examiner

Fig.2b.
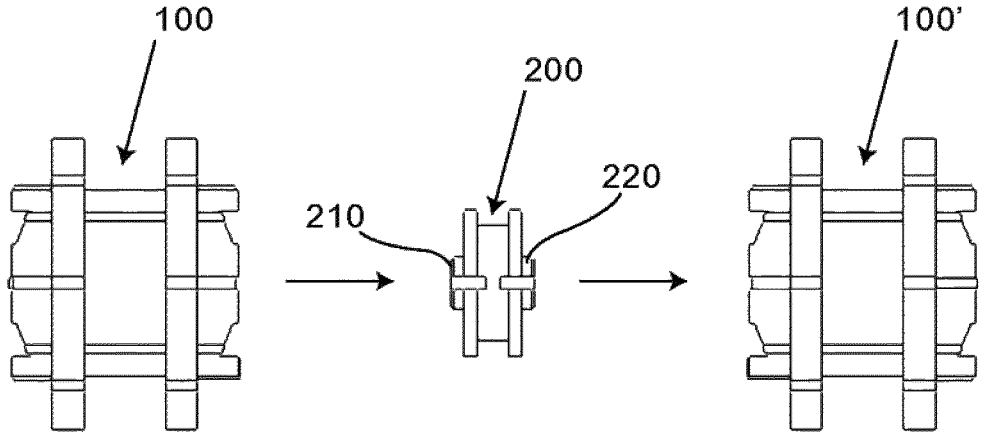
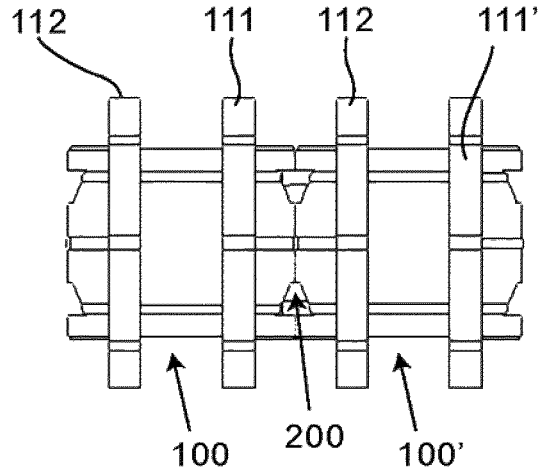
Fig.2c.

Fig.5a.
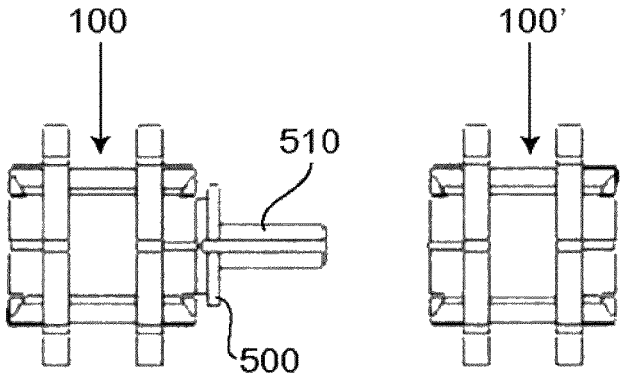
Fig.5b.
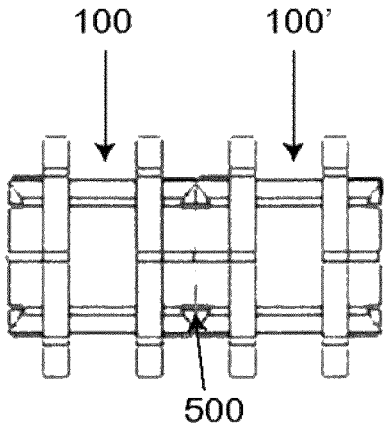
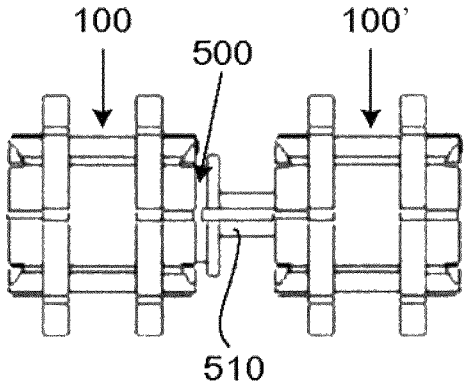
Fig.5c.

CONSTRUCTION SET

BACKGROUND OF THE INVENTION

The present invention relates to the field of construction sets and, in particular, to adaptations making it possible to increase the options for assembling the constitutive members of such a construction set.

DESCRIPTION OF THE PRIOR ART

The applicant has observed that the construction sets of the prior art have the drawback of requiring a plurality of specific construction members in addition to the basic construction members, to permit the creation of configurations in two and three dimensions of relatively complex volume shapes. This drawback has the result that a boxed set only permits the creation of a limited number of configurations, if only one.

Moreover, the construction sets of the prior art, by the geometry of their constitutive members, do not have the possibility of adjusting the angular positioning of one construction member relative to another, without using a full pivot link. This requirement reduces the options of possible shapes using the basic members, requires the presence of specific members and makes the creation of such shapes more complex and expensive.

BRIEF DESCRIPTION OF THE INVENTION

Proceeding from this state of the art, the applicant has conducted research which has resulted in the design of a construction set which, based on a particularly innovatory basic member, makes it possible in association with other basic members or other construction members, to remedy the drawbacks of the construction sets of the prior art.

The construction set of the invention is made of a plurality of different members interacting together for assembly and is notable in that one so-called connector member among said members has an essentially cylindrical body with a cylindrical surface that is preformed in order to interact for assembly with the correspondingly preformed bases of other connector members.

This feature of the invention is particularly advantageous in that it proposes, using a basic member, an assembly surface of circular profile which makes it possible to offer a wide range of options for adjustable angular assembly about the axis of the cylinder. These adjustable angular assemblies constitute a technological phenomenon, unknown from the prior art. Moreover, this connector is preformed to provide angular assemblies of the cylindrical surface with the base of other connector members. The connector member of the invention thus constitutes a basic member of the construction set capable of being used, as a result of simple assembly, to create complex volume shapes and providing kinematic possibilities.

According to a further particularly advantageous feature of the invention, the cylindrical surface of said connector member comprises at least one cylindrical projection protruding radially, interacting for assembly with at least one groove of suitable shape made in each base of the connector members. According to this feature, therefore, the cylindrical surface comprises male shapes to which the female shapes made in the base of the cylinder are attached. More specifically, to provide more rigidity and precision in the connection, the cylindrical surface of said connector member comprises two cylindrical projections protruding radially and two bases each comprising at least two grooves. According to the invention, the radial cylindrical projection is preformed with slots distributed at an angle about the axis of the cylinder formed by the connector member.

The features disclosed above provide a solution in a right-angled assembly of the connector members to one another (with the base on the cylinder). The axial assembly itself is achieved by the following features.

According to a further particularly advantageous feature of the invention, one of the members, known as the adapter member, consists of a body with two ends, each end being preformed axially to interact for assembly with zones of suitable shape made axially in each base of the connector member. More specifically, said adapter member has an essentially cylindrical body having in the region of its two bases a protruding shaft capable of interacting for assembly with the retracted cylindrical zones of suitable shape made axially in each base of the connector member.

The set of the invention thus provides both a right-angled assembly and an axial assembly of the basic members known as connector members, providing a wide range of assembly options. The presence of this adapter member allows the creation of elongated cylindrical shapes consisting of a plurality of assembled connector members, each able to receive on its cylindrical surface a plurality of connector members. The axial connection has been the subject of research by the applicant who has designed the connector and the adapter according to other particularly advantageous features. Thus, for example, the assembly created between the shaft of the adapter member and the axial hollow cylindrical zones made in the bases of the connector member constitutes a connection of the sliding pivot type allowing a reversible assembly. The axial connection between two connector members or between one connector member and an adapter member thus permits the pivoting, thus providing possibilities of kinematic rotation for the assemblies created using these two members.

Moreover, the length of the preforms involved in the axial assembly between two connector members by means of an adapter member, is such that the two connector members are substantially adjacent. Moreover, the dimensions of the connector member and those of the adapter member are such that once two connector members are axially assembled, the distance between the two radial cylindrical projections of the same connector is equal to the distance between the two adjacent radial cylindrical projections of the two different connectors assembled by the adapter member. Thus, the base of a connector member may be assembled at right angles both to a single connector member and to two assembled connector members. This feature contributes to the wide range of options for assembly provided by the construction set of the invention.

A further member of the construction set of the invention, known as the panel member, has a planar body of which at least one face is preformed with protruding volumes and hollow volumes to receive the cylindrical surface of said connector member for assembly.

This panel thus has the purpose of joining a planar surface to the cylindrical surface of the connector member. The elongate cylindrical shapes composed of connectors assembled axially may thus be joined to four faces formed by panel members to create a parallelepiped volume. Moreover, as is the case for the right-angled assembly of the connector member using one or more further connector members, one or more panel members may be joined over the entire periphery of the cylinder formed by one or more connector members. According to the invention, this panel member is also preformed, with protruding shapes and hollow shapes to receive the ends of said adapter member for assembly, which permits an axial mounting of the connectors on the panel.

A further member of the construction set known as the 45° connector member has the same shapes as a connector member but from which a part of its volume has been removed according to a dihedron at 45°, so that eight 45° connector members may be assembled on the cylindrical surface of the same connector member. Whilst it is only possible for one connector member to receive a limited number of standard connector members on its cylindrical surface, this removal of material thus makes it possible to provide more possibilities for the adjustable angular assembly on the cylindrical surface of the connector member.

A further member of the construction set known as the extendable adapter member has a shaft length which is greater than the shaft length of the basic adapter member (i.e. that disclosed above) in order to provide the possibility of separating the members which it joins. This member thus provides an extension of the connections between the different members of the set which an adapter member may connect, whilst permitting a return to a withdrawn position. This feature permits the creation of configurations with adjustable dimensions, which avoids providing a range of parts with predefined fixed dimensions. It permits, in particular, the distance to be adjusted between nodes or between the centres formed by the connector members.

A further member of the construction set, known as the extending connector member, has the same volumes as a connector member and receives, over at least one of its bases, extending arms of which one end is connected to the base of the connector and of which the other end comprises shapes capable of interacting with the body of an adapter member or an extendable adapter member.

This extending connector member may thus both create coaxial assemblies and interact with the body of the adapter member or the extendable adapter member, in order to facilitate their manipulation during the phases of assembly and disassembly.

A further member of the construction set, known as the extendable panel member, has the shape of two panel members joined by one of their ends so as to form a sliding surface in the plane consisting of said panels.

According to a further particularly advantageous feature of the invention, this extendable panel member consists of two identical parts of which the end of a first part has a shape complementary to the end of the second part, where the ends are preformed so as to form a sliding surface.

A further member of the construction set of the invention, known as the sphere member, has a spherical shape of which the surface has been preformed to receive the ends of the adapter members and the extendable adapter members for the purpose of adjustable angular assembly.

Naturally, further members of the set may be conceived to be assembled with the members disclosed above and create different interactions.

According to a feature capable of relating to all the members of the construction set of the invention, said members are made of plastics material and are made by moulding. Moreover, the adjustments between the members and the resilience of the material result in that the assemblies, unless there is a mechanical difficulty, are all able to be dismantled and allow both sliding and rotation, making the connections reversible.

Naturally, the invention is not limited to particular dimensions based on when the proportions and shapes interacting for assembly are adhered to. The applicant has, however, developed a particularly innovatory design, by conceiving additional parts to the basic members disclosed above. According to the invention, moreover, the set consists of a plurality of additional parts, substantially taking on at a different scale the same functions and the same proportions as said members, the dimensions of said additional parts being established so that said additional parts interact with one another and with members at different scales, for assembly. Thus, from parts having the same shape and same function, the applicant proposes not only additional parts capable of interacting together in accordance with the aforementioned features of the invention (at a different scale), but also interacting with members of a different scale. This feature multiplies the number of assembly options provided by the set of the invention.

The essential concepts of the invention described above in their simplest form, further details and features will emerge more clearly from reading the description which follows and with reference to the accompanying drawings, providing by way of non-limiting example an embodiment of a construction set according to the invention.

BRIEF DESCRIPTION OF THE DRAWINGS

FIG. 2*b* illustrates the axial assembly before assembly, FIG. 2*c* illustrates the axial assembly once assembled, FIG. 5*a* illustrates the axial assembly by means of an extendable member before assembly, FIG. 5*b* illustrates the axial assembly of two connector members by means of an extendable adapter member, after assembly but in the retracted position, FIG. 5*c* illustrates the axial assembly of two connector members by means of an extendable adapter member, after assembly but in the deployed position.

DESCRIPTION OF PREFERRED EMBODIMENTS

The construction set consists of a plurality of construction members of which the shapes, the specifics and the interactions will be provided in further detail below.

Figure 1:
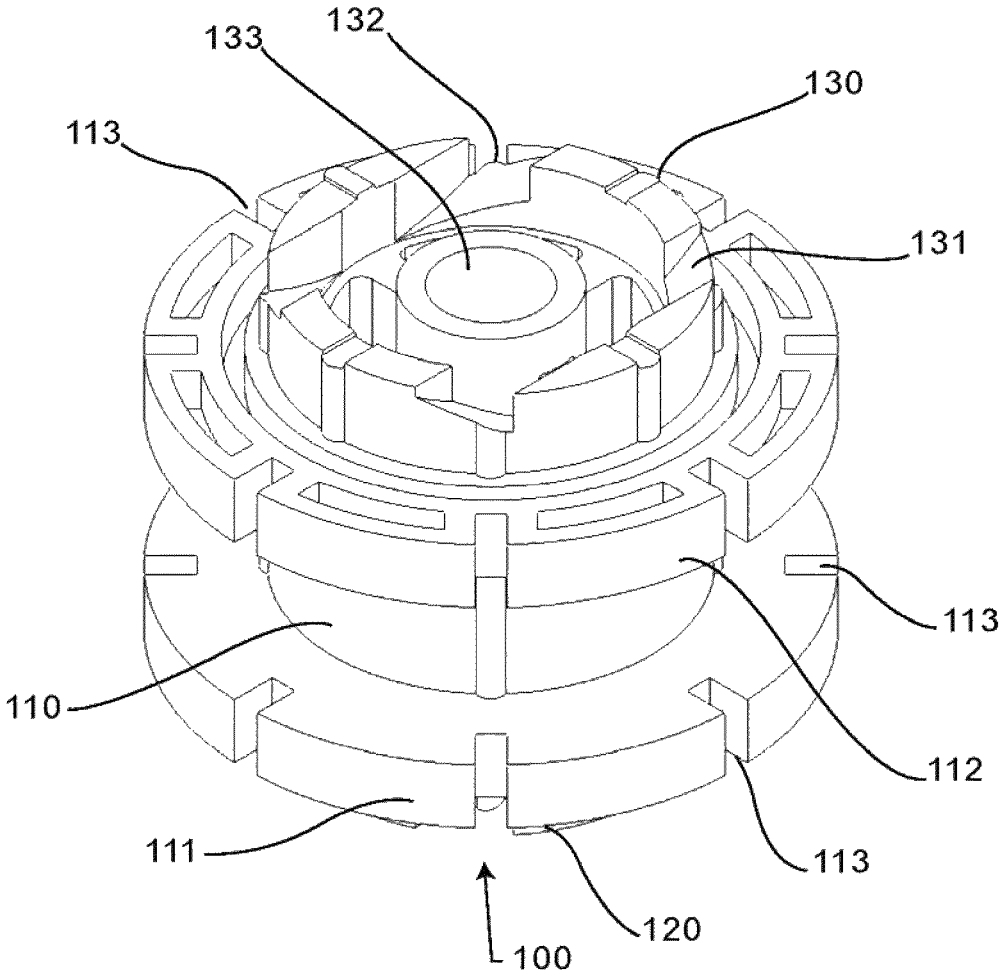
FIG. 1 is a schematic drawing of a perspective view of an embodiment of a connector member according to the invention.
Figure 1A:
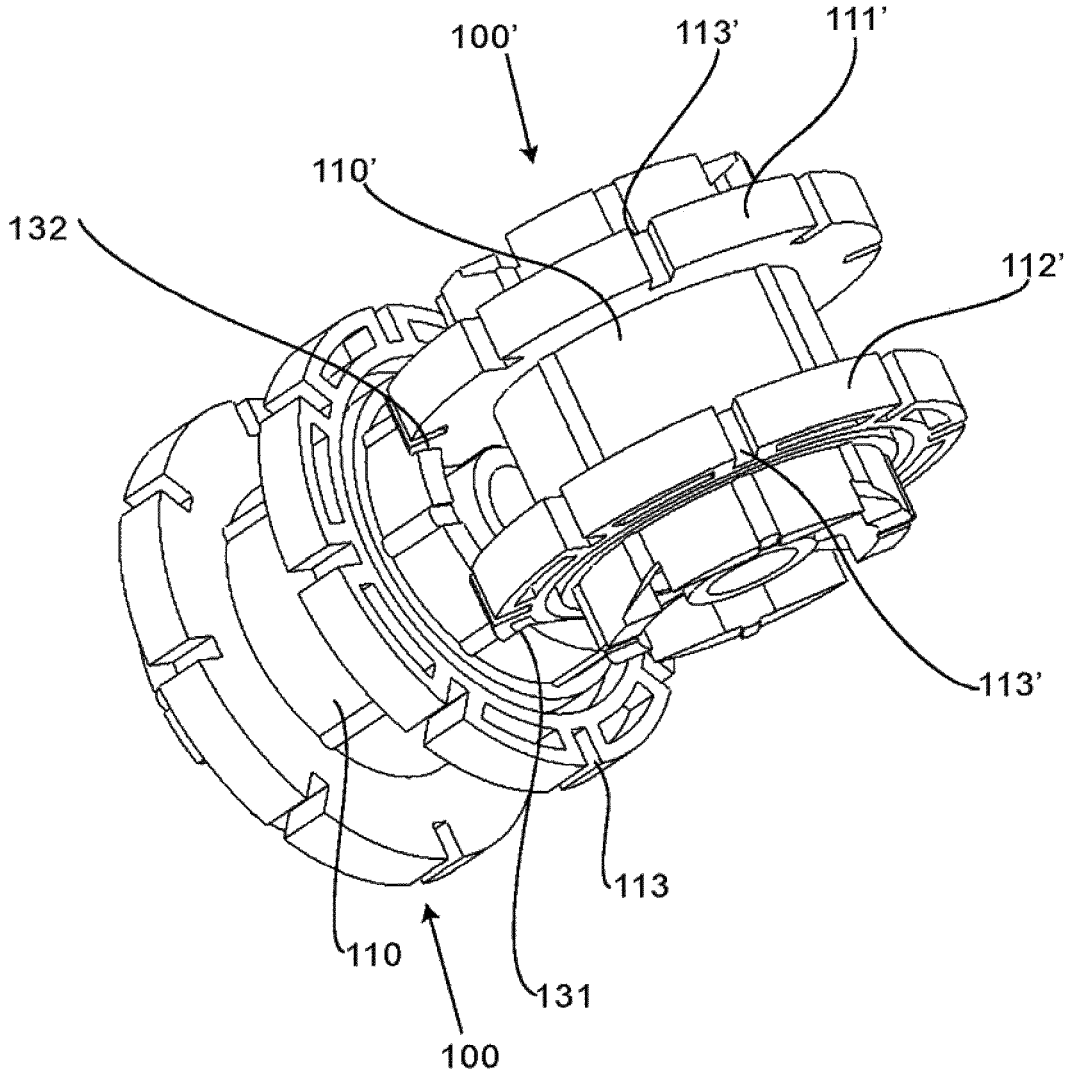
FIG. 1*a* is a schematic drawing of a perspective view of a right-angled assembly of two connector members.

As illustrated in the drawing of FIG. 1, one of the members of the construction set, known as the connector member, referenced 100, has an essentially cylindrical body of which the cylindrical surface 110 is preformed to interact for assembly with the correspondingly preformed bases 120 and 130 of other connector members 100' as illustrated in the drawing of FIG. 1*a*.

According to the invention, and according to the illustrated embodiment, the cylindrical surface 110 of said connector member 100 comprises two cylindrical projections 111 and 112 protruding radially and two bases 120 and 130 each comprising at least two grooves, only the grooves 131 and 132 appearing on the drawing. The assembly of radial projections 111' and 112' of the connector 100' in the grooves 131 and 132 of the connector 100 is illustrated in FIG. 1*a*. This right-angled assembly allows the sliding of the radial projections inside the grooves to provide an adjustable angular connection about the axis of the cylinder formed by the connector 100'. As illustrated, each connector 100 or 100' may receive a plurality of connectors over its cylindrical periphery.

In order to facilitate this connection which, whilst ensuring the assembly, allows the angular sliding about the axis of the cylinder, the grooves, for example 131 and 132, are advantageously preformed with the profile and according to the radius of the radial cylindrical projections, for example 111' and 112'. This frictional assembly joining the cylindrical or curved surfaces with planar surfaces optimises the connection between the different members, a connection which permits the sliding of the base of the connectors onto the cylindrical periphery of a different connector.

According to the invention and according to the illustrated embodiment, the cylindrical radial cylindrical projections 111, 112, 111' and 112' are preformed with slots 113 and 113' distributed at an angle about the axis of the cylinder formed by the connector member. The function of the assembly of these slots 113 and 113' will appear during the description of the panel member. A further function lies in the visual marker which they provide to orientate the assemblies at the desired angle. According to the non-limiting embodiment illustrated, the slots are arranged according to an angular spacing which is equal to forty five degrees. The fixing of the angular spacings ensures, in a non-limiting manner, the predefining of the angular orientation of the members with one another.

Moreover, as illustrated, some protruding or retracted volumes do not have direct functions for the assembly but are provided by the applicant to provide an optimised resilience and rigidity, whilst using the least material possible.

According to the illustrated embodiment, the connector member 100 has symmetrical volume shapes, both along a plane passing through the axis of the cylinder which it forms and along a plane perpendicular to said axis and passing through the centre of the connector 100.

As illustrated and according to the principles of a construction set, the assembly conforms to a spacing unit allowing the assembly of further members. Thus, the connectors have a nominal height and diameter, which are increased or reduced, of the radial grooves or projections respectively preforming the bases and the cylindrical periphery. The applicant has designed the connector members such that, once assembled and the retracted volumes are filled by the protruding volumes, the nominal height of the connector equals the nominal diameter of the connector.

This correspondence between the height and the diameter of the basic member of the construction set of the invention makes it possible to propose, in spite of the cylindrical shape, a base construction unit which is almost equivalent to that of a cube, providing the capacity for angular positioning which a cubic base member may provide.

Figure 1B:
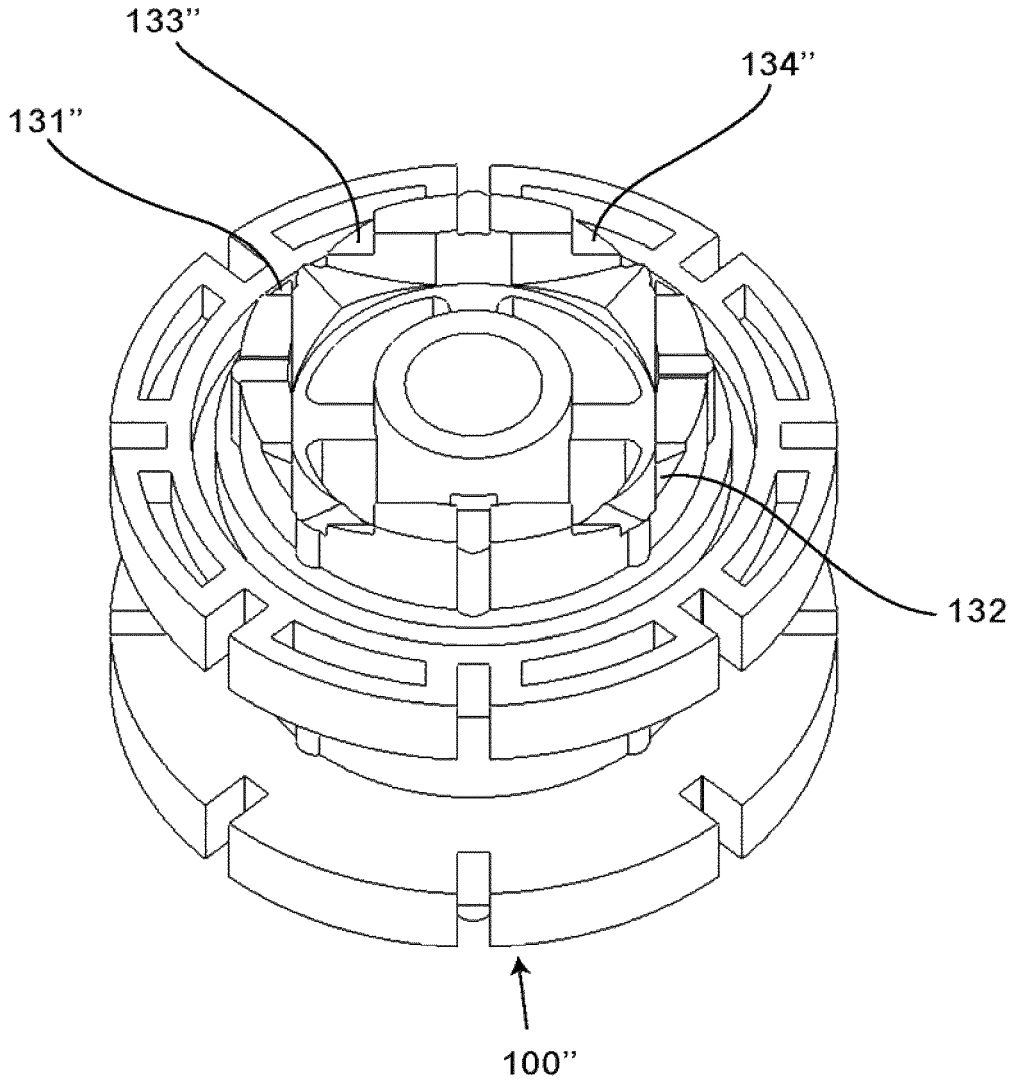
FIG. 1*b* is a schematic drawing of a perspective view of a second embodiment of a connector member according to the invention.
Figure 2:
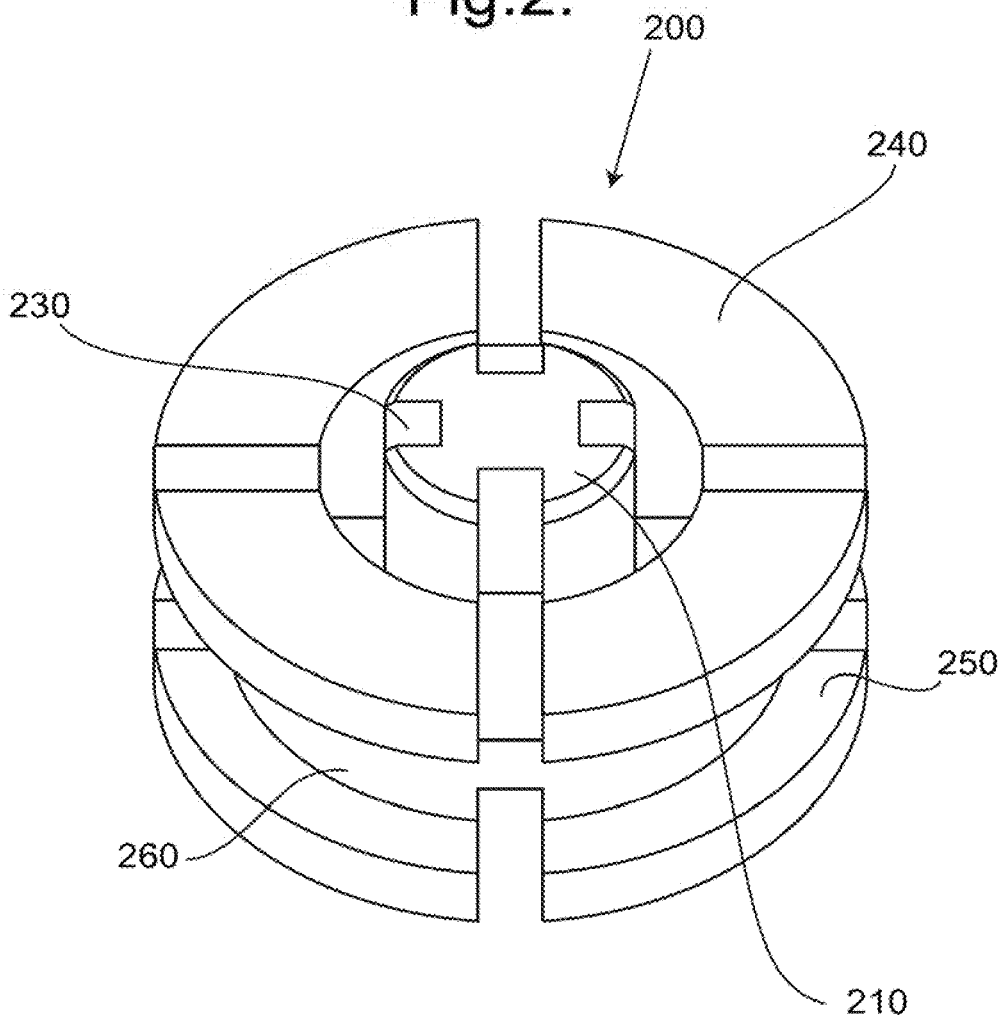
FIG. 2 is a schematic drawing of a perspective view of an embodiment of an adapter member according to the invention.
Figure 2A:
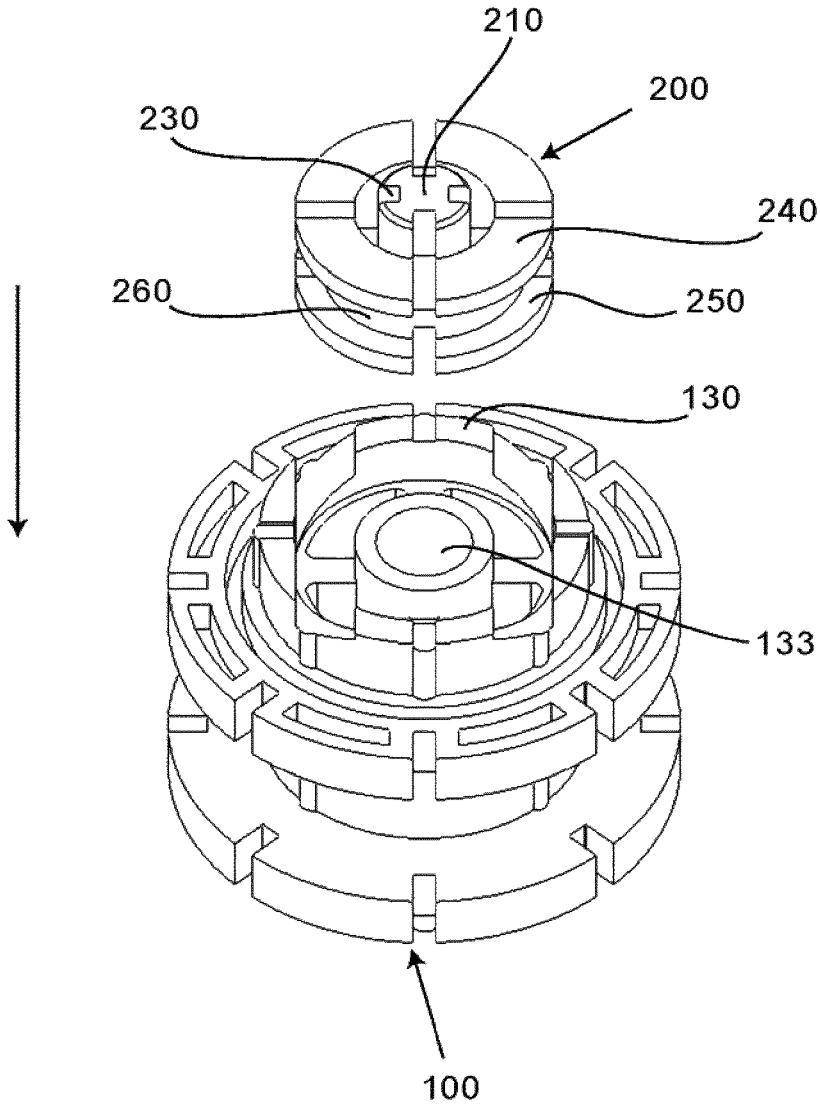
FIG. 2*a* is a schematic drawing of a perspective view illustrating the correspondence of shapes between the adapter member and the connector member.

According to an embodiment illustrated in FIG. 1*b* where only the base 130" of the connector 100" appears, the base of the connector member is preformed with two pairs of grooves 132", 131" and 133" and 134" arranged at ninety degrees to one another in order to provide two angles of assembly for the radial projections 112 and 111.

The axial connection of the connectors to one another is implemented using a further member of the set. As illustrated in the drawing of FIGS. 2, 2*a*, 2*b*, 2*c*, one of the members, known as the adapter member and referenced 200, consists of a body with two ends 210 and 220, each end being preformed axially to interact for assembly with zones of suitable shape 133 made axially in each base 120 and 130 of the connector member 100.

According to the invention and as illustrated, said adapter member 200 has an essentially cylindrical body, having in the region of its two bases 210 and 220 a protruding shaft capable of interacting for assembly with retracted cylindrical zones 133 of suitable shape, made axially in each base 120 and 130 of the connector member 100. The assembly made between the shaft 210 and 220 of the adapter member 200 and the hollow axial cylindrical zones 133 made in the bases 120 and 130 of the connector member 100, constitutes a connection of the sliding pivot type. When the adapter 200 is not joined to these retracted cylindrical zones 133, said retracted cylindrical zones remain free for further assemblies, such as the right-angled assembly with the radial projections of a further connector 100.

The assembly between two connector members 100 and 100' implemented by the adapter 200 is illustrated in FIGS. 2*b* and 2*c* where it is apparent that the length of the preforms taking part in the axial assembly between two connector members 100 and 100' by means of an adapter member 200, is such that the two connector members 100 and 100' are substantially adjacent. It is apparent, in particular, in FIG. 2*c* that the dimensions of the connector member 100 and 100' and those of the adapter member 200 are such that, once two connector members 100 and 100' are assembled axially, the distance between the two radial cylindrical projections 111 and 112 or 111' and 112' of the same connector 100 or 100' is equal to the spacing of the two adjacent radial cylindrical projections 111 and 112' of the two different connectors 100 and 100' assembled by the adapter member 200 which appears in the region of the grooves 131 and 132 made in the bases of the connectors.

According to a particularly advantageous feature of the invention, the male members forming the adapter member 200 are preformed with longitudinal grooves 230 which contribute to the resilience of the connection and prevent any compression of air in the hollow zone in which it is positioned for assembly.

The adapter member 200 further comprises, associated with said shafts, at least one coaxial flange, and in this case the coaxial flanges 240 and 250, of which the cylindrical surfaces interact with hollow cylinders made in the bases of the connectors in order to provide an optimised assembly associating not only the cylindrical penetration of the shafts in the hollow cylinders of the bases of the connectors but also the cylindrical penetration of at least one flange in a hollow cylinder, which is also correspondingly preformed in the base.

According to a further particularly advantageous feature, said flanges are two in number and spaced apart along the body of the adapter so as to have a peripheral hollow zone 260 facilitating the handling of the adapter 200 for its assembly and its disassembly.

Figure 3:
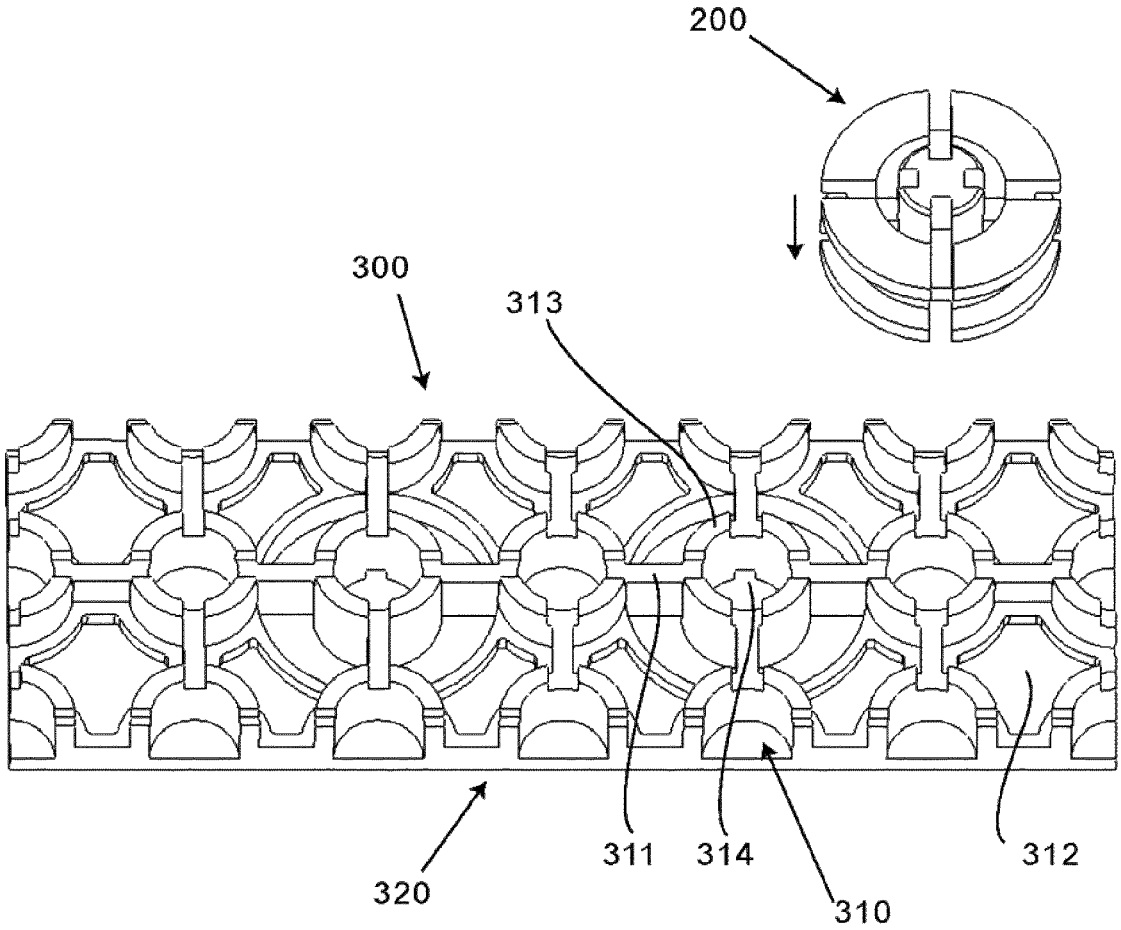
FIG. 3 is a schematic drawing of a perspective view of an embodiment of a panel member according to the invention, to which the shapes of the adapter member correspond.
Figure 3A:
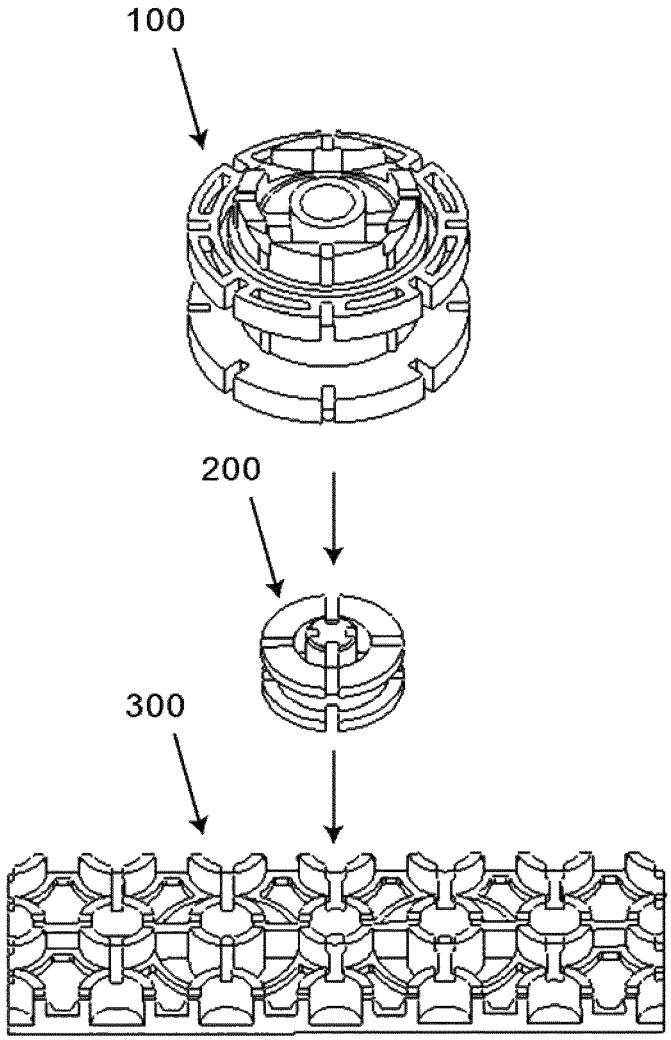
FIG. 3*a* illustrates the axial assembly with a connector member by means of an adapter member.
Figure 3B:
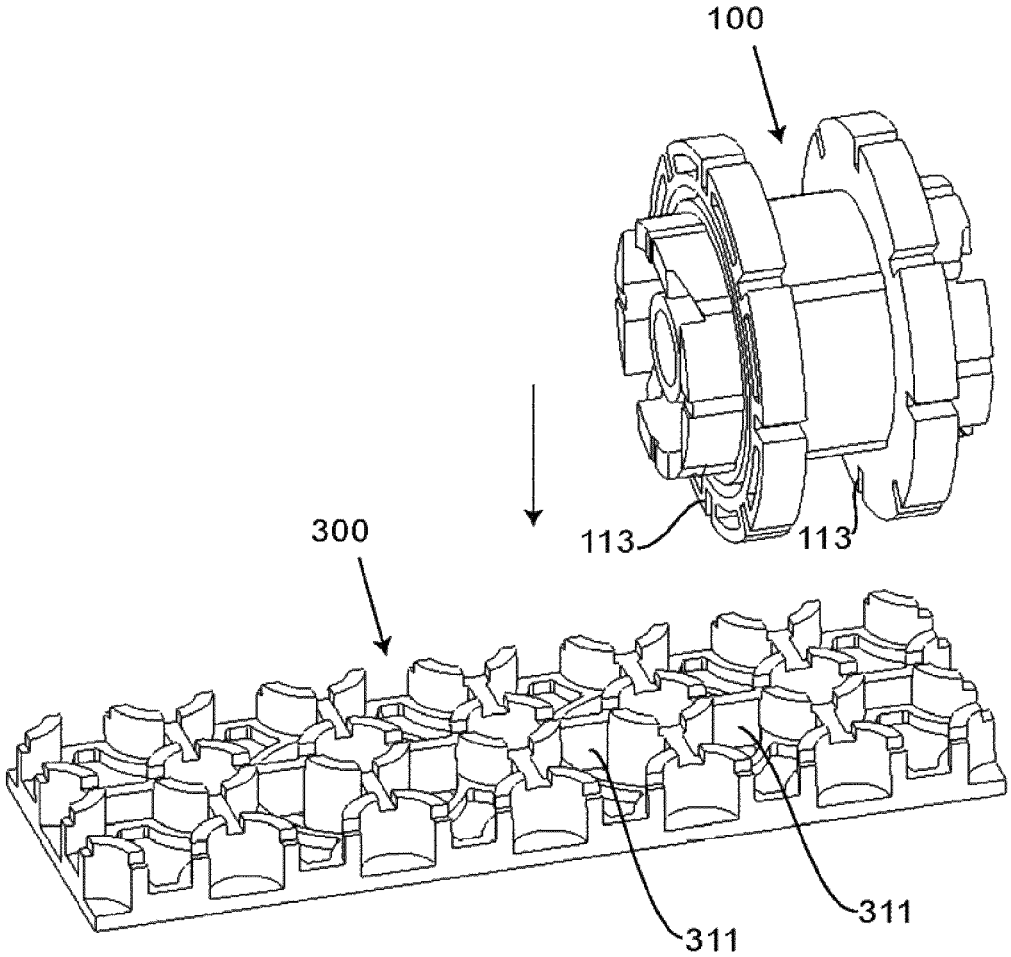
FIG. 3*b* illustrates a right-angled assembly between the panel member and the connector member.

The construction set consists of a further member, known as the panel member, which is illustrated by FIGS. 3, 3*a*, 3*b*. This panel member, referenced 300, has a planar body, of which at least one face 310 is preformed with protruding volumes 311 and hollow volumes 312 to receive the cylindrical surface 110 of said connector member 100 for assembly.

According to a particularly advantageous feature of the invention not appearing on said figures, said panel member 300 is preformed on its two faces 310 and 320.

More specifically, said panel member 300 is preformed with protruding ribs 311 substantially perpendicular to the plane and having a thickness and height suitable for assembly, and for the depth of the slots 113 made in the radial projections 111 and 112 of the connector members 100. Said projections 311 and said slots 113 participate in the assembly illustrated in FIG. 3*b*. Moreover, according to a further particularly advantageous feature, the thickness of the panel member 300 and the width of the slots 113 made in the radial projections of the connector members 100 correspond to allow an assembly of the connector 100 over the thickness of the panel member 300 such that the axis of the connector 100 is coplanar with the plane formed by the panel member 300.

The protruding shapes with which said panel 300 is provided also allow assembly using the radial projections of the connector members without using said slots, which permits an assembly with variable angular positioning. Moreover, as the axial assembly of two (or more) connectors maintains a regular spacing between the radial cylindrical projections, the panel member is preformed to receive both the radial projections of a single connector as well as an assembly of connectors.

According to the invention, said panel member 300 is preformed with protruding shapes 313 and hollow shapes 314 to receive the ends 210 or 220 of said adapter member 200 for assembly, as illustrated in the drawing of FIG. 3. Thus, said panel member is preformed with at least one hollow cylindrical perpendicular projection 313 of which the recessed shape 314 receives the protruding shaft 210 or 220 defining each end of the adapter member for assembly.

The possibility of axially fixing the adapter members 200 allows the axial fixing of a connector member 100 as illustrated in FIG. 3*a*.

The possibility of fixing the adapter members 200 also allows the fixing of two panel members 300 to one another and parallel to one another by stacking in the same direction or perpendicularly. This possibility is increased by the fact that the panel member is preformed on its two faces.

Figure 3C:
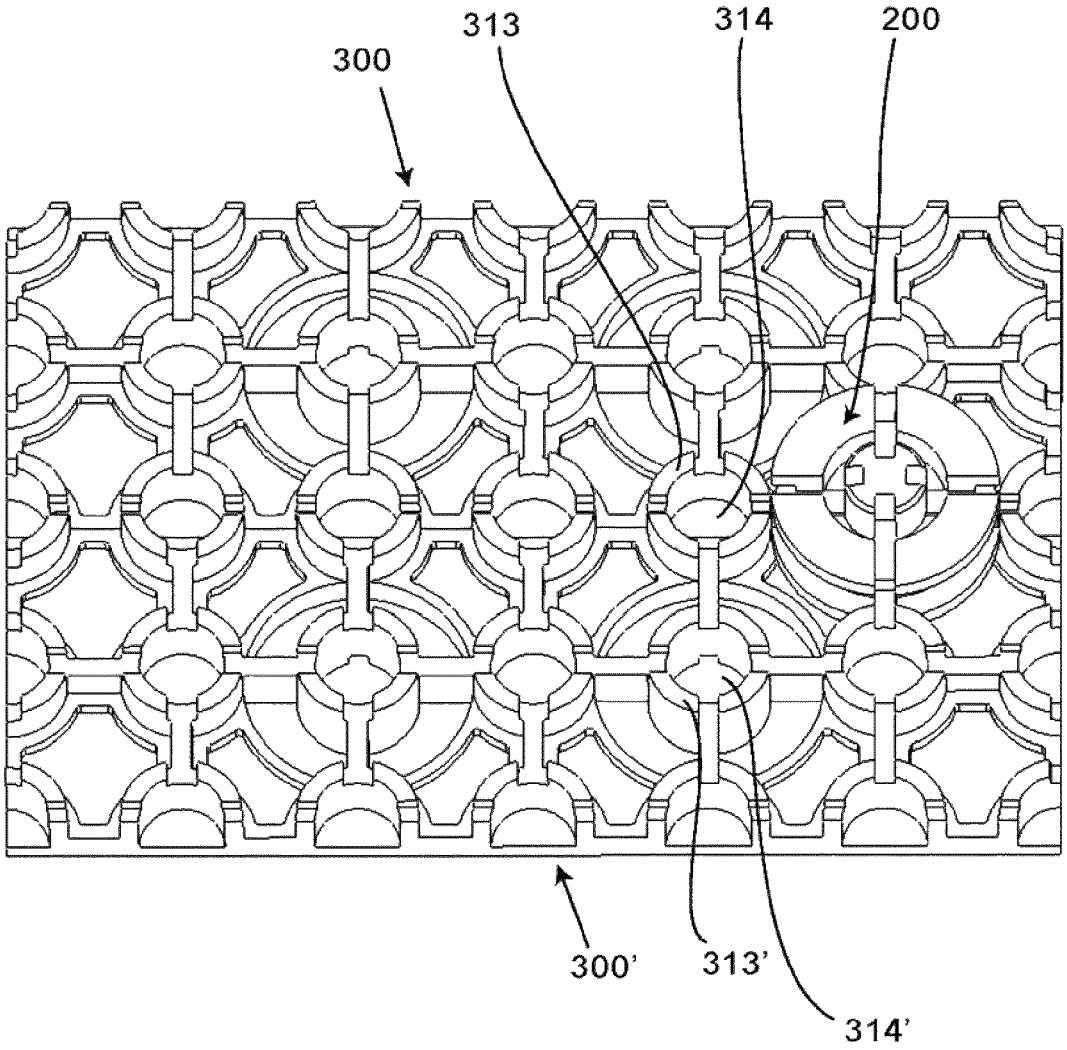
FIG. 3*c* illustrates an abutment between panel members implemented by an adapter.

Moreover, as illustrated in the drawing of FIG. 3*c*, the adapter member 200 ensures the abutment of the panels 300 and 300' with one another. In this drawing, the edges of the panels are preformed with protruding half-shapes 313 and hollow half-shapes 314, with which the protruding members and hollow members of the adapters 200 interact.

Thus preformed, the panel members may be assembled end to end, face to face, back to back, face to back, aligned axially and transversely which provides a plurality of possibilities of assembly to the user.

Moreover, according to the illustrated embodiment and according to the invention, the edges of the panel members 300 are not completely edged with protruding shapes so that a rotating assembly, sliding with the radial cylindrical projection(s) of a connector member is possible.

Figure 4:
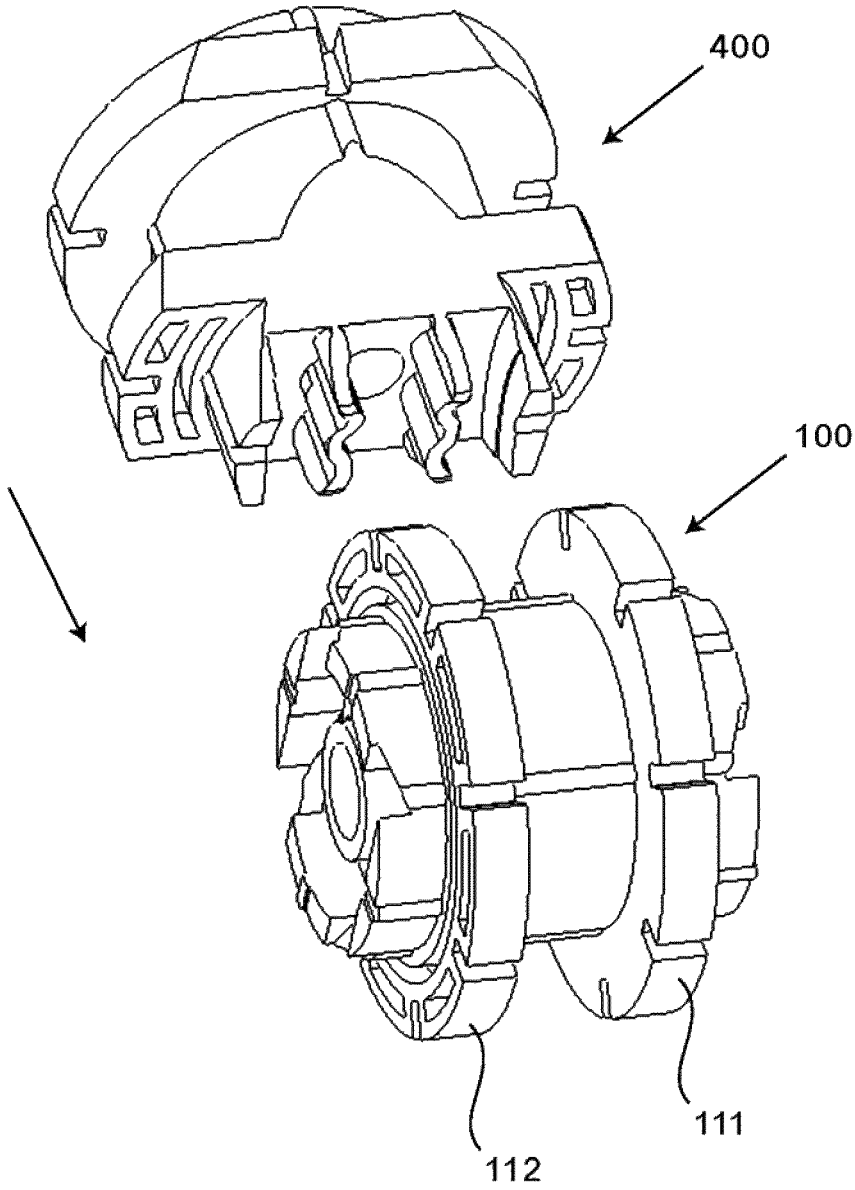
FIG. 4 is a schematic drawing in a perspective view of an embodiment of a 45° connector member with its correspondence with a connector member.
Figure 4A:
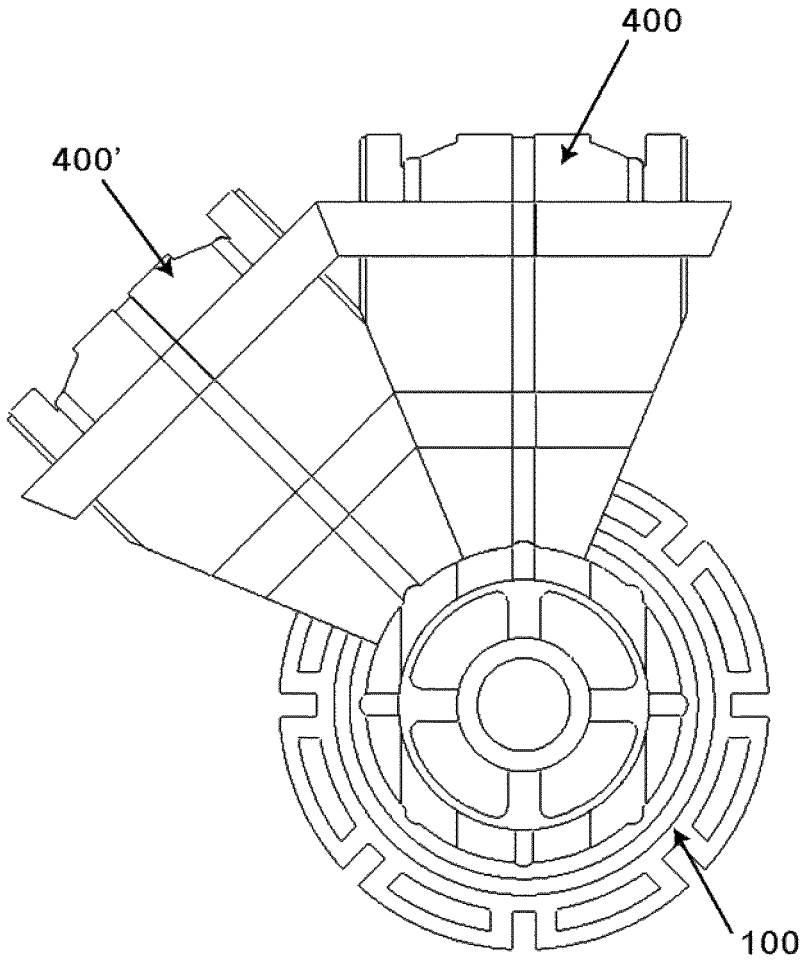
FIG. 4*a* illustrates the right-angled assembly of a plurality of 45° connector members to a connector.
Figure 5:
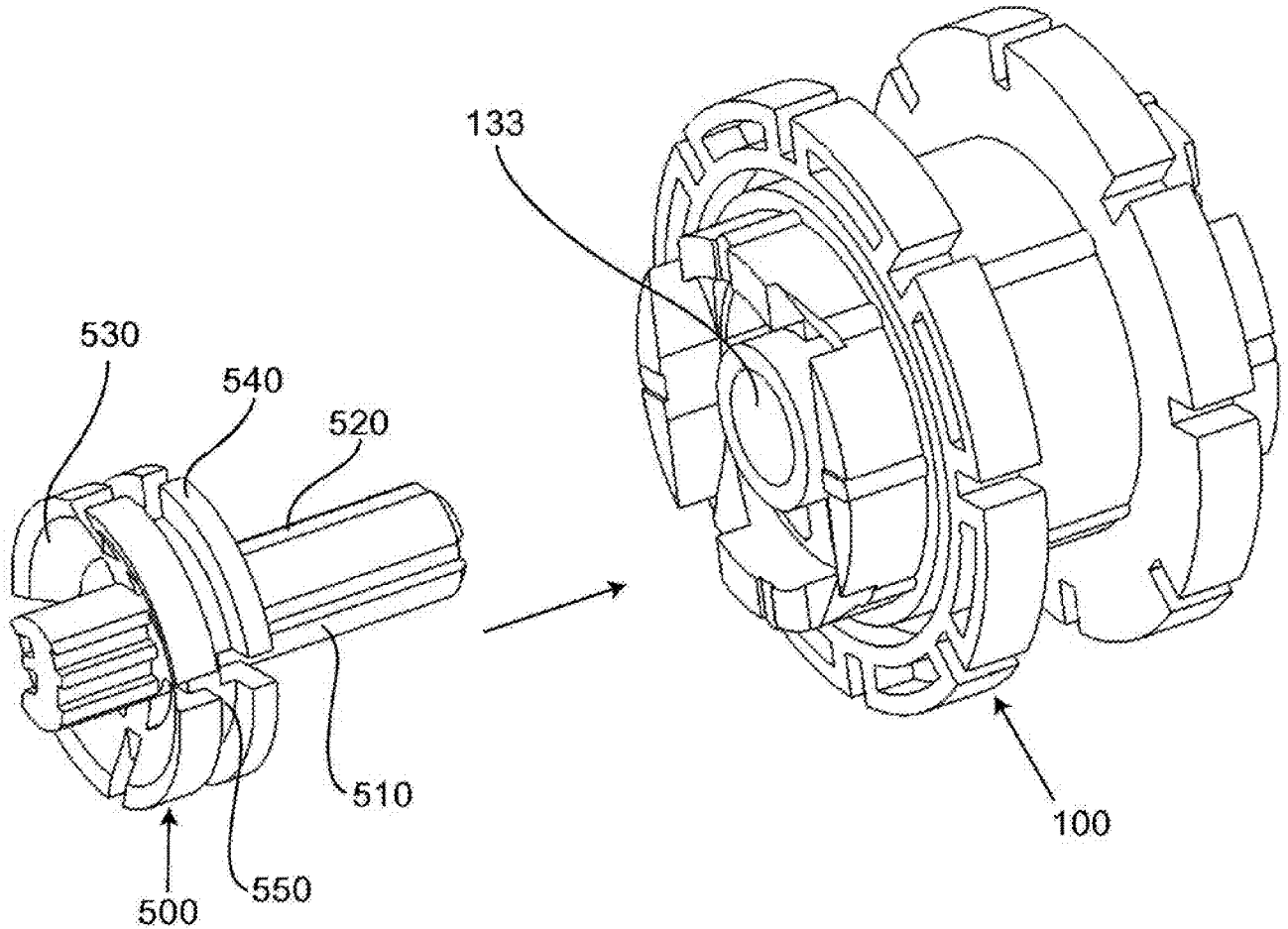
FIG. 5 is a schematic drawing of a perspective view of an embodiment of an extendable adapter member brought opposite a connector member.

A further member of the construction set, known as the 45° connector member, referenced 400, is illustrated by FIGS. 4 and 4*a*, and has the same shapes as a connector member 100 but from which a part of its volume has been removed according to a dihedron at 45° such that eight 45° connector members may be assembled on the cylindrical surface of the same connector member 100 according to the arrangement shown in FIG. 4*a*.

The dihedron is defined by two planes intersecting along a straight line defined by the axis of the cylinder of the connector 100 on which the 45 degree connector 400 is fitted.

A further member of the construction set, known as the extendable adapter member, referenced 500, is illustrated by the drawings of FIGS. 5, 5*a*, 5*b* and 5*c* and has a shaft length 510 greater than the shaft length of the adapter base member 200, in order to provide the possibility of separating the members which it joins whilst providing the possibility of a pivot connection.

The possibilities provided by this novel member 500 are numerous and one possibility is illustrated by the drawings of FIGS. 5*a*, 5*b*, 5*c* within the scope of an axial assembly of two connectors 100 and 100'.

Thus, as illustrated, the shaft 510 has a much greater length on one side of the member 500 on which the connector member 100' is capable of sliding to pass from a withdrawn position illustrated in FIG. 5*b* to a deployed position illustrated in FIG. 5*c*. Thus, the extendable adapter 500 may have the same functions as those of the adapter 200. The constituent members of the construction set of the invention may thus be interchanged or even provide the function of a member which is no longer available.

As for the basic adapter member, the male members constituting the extendable adapter member 500 are preformed with longitudinal grooves 520 which contribute to the resilience of the connection and avoid any compression of air in the hollow zone in which it is positioned for assembly.

Similarly, the adapter member 500 further comprises, associated with said shaft 520, coaxial flanges 530 and 540 of which the cylindrical surfaces interact with hollow cylinders made in the bases of the connectors 100 in order to provide an optimised assembly, associating not only the cylindrical penetration of the shaft in the hollow cylinders of the bases of the connectors 100 but also the cylindrical penetration of at least one flange 540 in a hollow cylinder, also correspondingly preformed in the base.

According to a further particularly advantageous feature, said flanges 530 and 540 are two in number and are spaced along the body of the extendable adapter so as to have a hollow peripheral zone 550 facilitating the handling of the extendable adapter 500 for its assembly and disassembly.

Figure 6A:
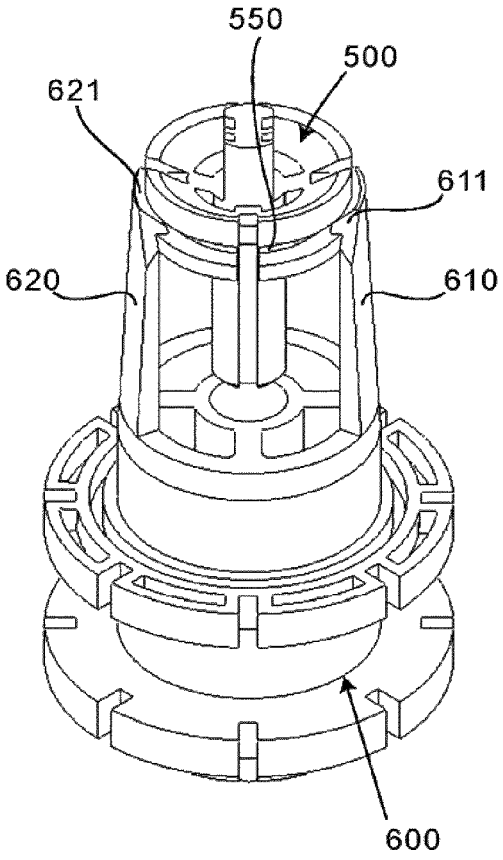
FIGS. 6*a* and 6*b* are schematic drawings in a perspective view of an embodiment of an extending connector member according to the invention.
Figure 6B:
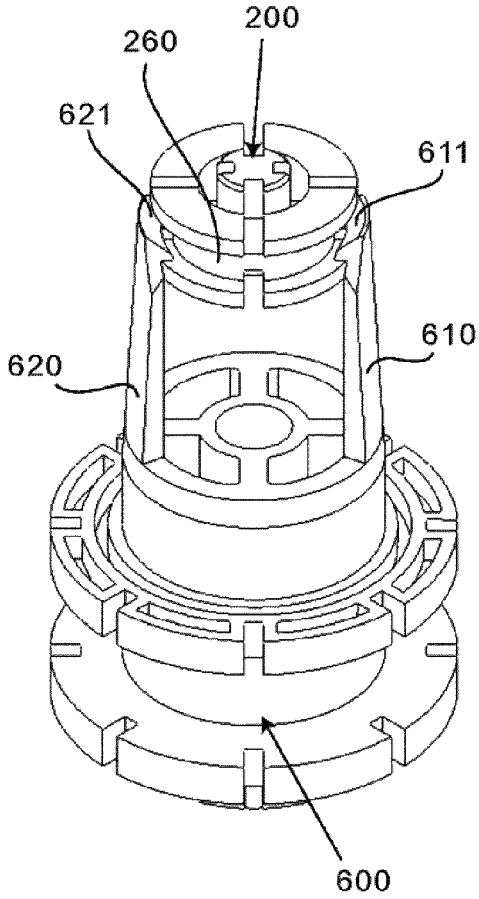

FIGS. 6*a* and 6*b* illustrate a further member of the construction set known as the extending connector member, referenced 600, which has the same volumes as a connector member 100 and receives, over at least one of its bases, extending arms 610 and 620 of which one end is connected to the base of the connector and of which the other end comprises shapes 611 and 621 capable of interacting for coaxial assembly with the connector of the body of an adapter member 200 or an extendable adapter member 500.

As illustrated, the protruding shapes 611 and 621 are introduced into the peripheral hollow zone with which the adapter members 200 and extendable adapter 500 are provided.

Figure 7:
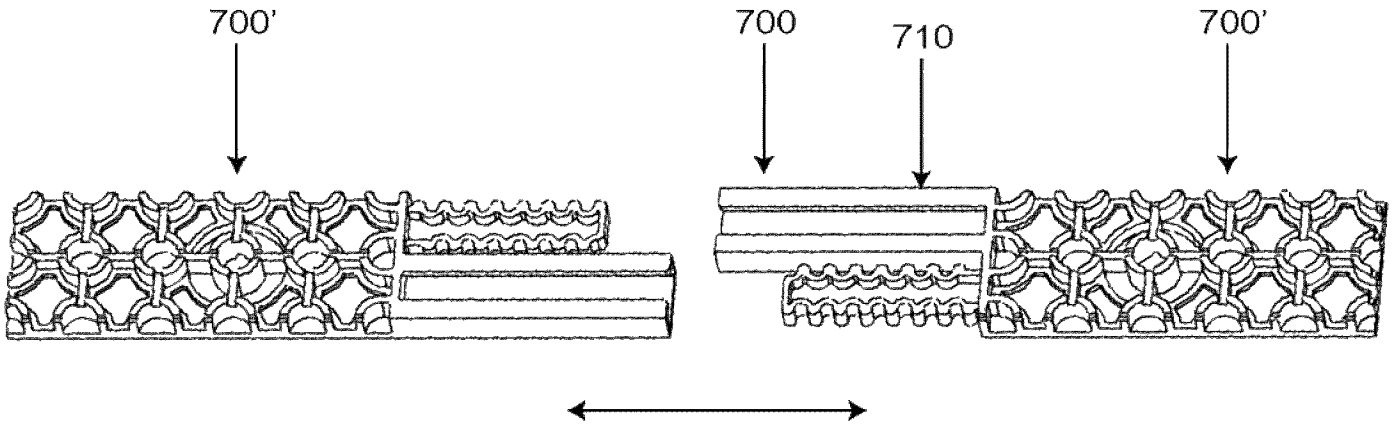
FIG. 7 is a schematic drawing in a perspective view of an embodiment of an extendable panel member.

FIG. 7 shows a further member of the construction set, known as the extendable panel member 700, which has the shape of two panel members joined by one of their ends so as to form a sliding surface 710 in the plane constituted by said panels.

As illustrated, said extendable panel member is composed of two identical parts 700' and 700" of which the end of one first part has a shape complementary to the end of the second part, the ends being preformed so as to form a sliding surface.

Figure 8:
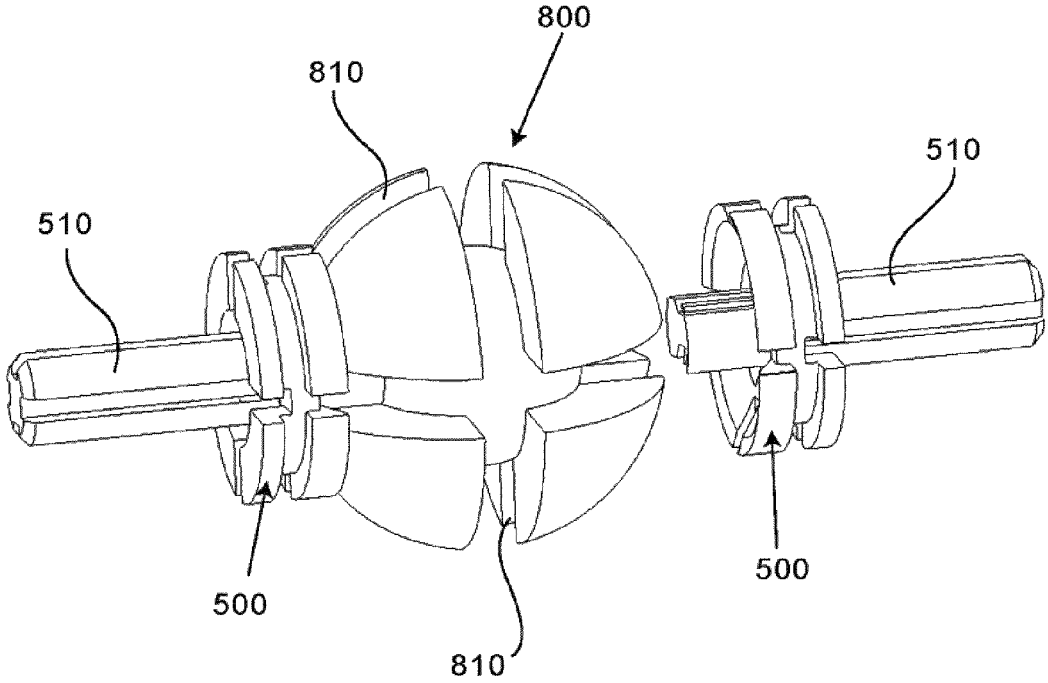
FIG. 8 is a schematic drawing in a perspective view of an embodiment of a spherical member according to the invention on which two extendable adapter members are assembled.
Figure 9:
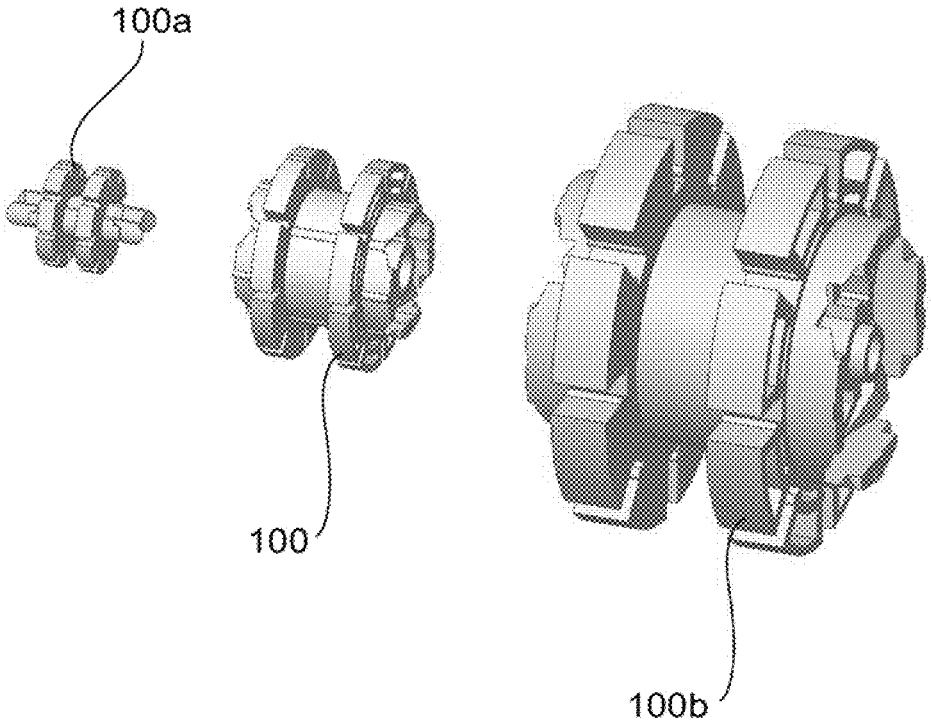
FIG. 9 is a schematic drawing in a perspective view of an embodiment of additional parts showing the functions and the shape of the basic connector member.

FIG. 8 shows a further member of the construction set of the invention, known as the sphere member, referenced 800, which has a spherical shape and of which the surface has been preformed to receive the ends of the adapter members 200 and/or, as illustrated, the extendable adapter members 500 for the purpose of adjustable angular assembly.

The sphere 500 is thus preformed with three circular grooves 810 at right angles in which the ends of the shafts of the extendable adapter members are introduced. According to the illustrated embodiment, a first groove is on an equatorial plane and the two others constitute two meridians arranged at 90 degrees to one another.

In order to optimise this assembly, the body of the extendable adapter member 500, of which the edge consists of a flange, has a retracted hemispherical shape in order to mate with the sphere 800 when the short end of the shaft 510 is positioned in the groove 810.

FIG. 8 illustrates the feature for the connector member 100 conceived by the applicant, according to which the construction set is notable in that it consists of a plurality of additional parts substantially taking on at a different scale the same functions and the same proportions as said members, the dimensions of said additional parts being established so that said additional parts interact with one another as well as with members at different scales, for assembly.

Thus, the connector member 100*a* takes on the shape and the functions of the basic connector member 100 but at a smaller scale. This connector member 100*a* has the shapes and proportions necessary for assemblies provided for the basic connector member, with the members (connecting or otherwise) at the same scale. This connector member 100*a* is, moreover, defined so that it may interact for assembly with the basic connector member 100. The same applies to the relationship between the basic connector member 100 and the connector member 100*b* which has the same shapes and proportions as the basic connector member 100 but at a larger scale.

In addition to these axial assemblies, the possibilities for radial assemblies are numerous. For example, the distance separating the internal cheeks of the radial projections of a connector member is appropriate for the distance separating the external cheeks of the connector member at a scale immediately below, so as to allow the assembly. The same applies to the thickness of said radial projections of a connector member which is appropriate for the distance separating the internal cheeks of the radial projections of a connector member at a scale immediately below, in order to permit the assembly.

It is understood that the construction set, which has been disclosed and shown above, has been disclosed and shown as a disclosure rather than a limitation of the invention. Naturally, various developments, modifications and improvements could be provided to the above example without departing from the scope of the invention.

For example, it is envisaged to motorise certain articulations proposed by the constitutive members of the set. The connector may thus receive in its hollow core the body of an electric motor of which the hollow motor shaft, which is coaxial with the axis of the connector, may receive the shafts of the other members or any other important part to be articulated.

The invention claimed is:

1. Construction set comprising a plurality of different members configured for interacting together for assembly, the different members comprising connector members, each of the connector members comprising an axis, an essentially cylindrical portion that defines a preformed cylindrical surface, at least a first preformed base disposed at a first axial end thereof, and at least one groove of a predetermined shape defined in the first preformed base, the preformed cylindrical surface of at least a first of the connector members being configured to interact for assembly with the first preformed bases of other of the connector members, the first connector member comprising at least a first cylindrical projection protruding radially from the cylindrical surface thereof and configured to interact for assembly with the at least one groove of the other of the connector members.

2. Construction set according to claim 1, wherein the first connector member comprises a second cylindrical projection protruding radially from the cylindrical surface thereof, at least a second preformed base disposed at a second axial end thereof, and the at least one groove of each of the first and second preformed bases comprises at least two grooves.

3. Construction set according to claim 1, wherein the first cylindrical projection of the first connector member is preformed with slots distributed at an angle about the axis of the first connector member.

4. Construction set according to claim 1, wherein the at least one groove in the first preformed base of the first connector member comprises two pairs of grooves arranged at ninety degrees to one another.

5. Construction set according to claim 1, wherein the connector members are configured such that, once the first connector member is assembled with the other of the connector members so that the first cylindrical projection of the first connector member is interacted with the at least one groove of the other of the connector members, the first connector member has a nominal height and a nominal diameter that are equal.

6. Construction set according to claim 1, wherein each of the connector members further comprises a first shaped zone disposed at the first axial end thereof and a second shaped zone disposed at an oppositely-disposed second axial end thereof, the different members further comprising an adapter member, the adapter member comprising a body with two axial ends, and each of the axial ends is configured to interact for assembly with the first and second shaped zones of the connector members.

7. Construction set according to claim 6, wherein said adapter member has an essentially cylindrical body comprising two preformed bases disposed at oppositely-disposed axial ends, having in the region of its two bases a protruding shaft configured to interact for assembly with retracted cylindrical zones of suitable shape made axially in each base of the connector member.

8. Construction set according to claim 7, wherein the assembly made between the shaft of the adapter member and the hollow axial cylindrical zones made in the bases of the connector member constitutes a sliding pivot connection.

9. Construction set according to claim 6, wherein the length of the preformed end taking part in the axial assembly between two connector members by means of the adapter member, is such that the two members are substantially adjacent.

10. Construction set according to claim 6, wherein said adapter member comprises, associated with said protruding shafts, at least one coaxial flange of which the cylindrical surfaces interact with the hollow cylinders made in the bases of the connectors.

11. Construction set according to claim 10, wherein said flanges are two in number and are spaced apart along the body of the adapter so as to have a peripheral hollow zone facilitating the handling of the adapter for its assembly and disassembly.

12. Construction set according to claim 1, wherein the different members further comprise a panel member, the panel member comprising a planar body with at least one face with protruding volumes and hollow volumes configured to interact for assembly with the cylindrical surface of the first connector member.

13. Construction set according to claim 12, wherein said panel member is preformed on its two faces.

14. Construction set according to claim 12, wherein said panel member is preformed with substantially perpendicular protruding ribs having a thickness and a height suitable for assembly, and for the depth of the slots made in the radial projections of the connector members.

15. Construction set according to claim 12, wherein said panel member comprises protruding shapes and hollow shapes configured to interact for assembly with the axial ends of said adapter member.

16. Construction set according to claim 12, wherein said panel member comprises at least one hollow cylindrical perpendicular projection of which the recessed shape is configured to interact for assembly with the protruding shaft defining each end of the adapter member.

17. Construction set according to claim 12, wherein edges of the panel member comprises protruding half-shapes and hollow half-shapes configured to interact for assembly with the protruding members and hollow members of the adapter member.

18. Construction set according to claim 12, wherein edges of the panel member are not completely edged with protruding shapes, the panel members configured to interact for assembly with the radial cylindrical projection(s) of a connector member to form a rotating assembly.

19. Construction set according to claim 1, wherein the different members further comprise a 45° connector member, the 45° connector member comprising a body having substantially the same shape as the connector member but from which a part of its volume has been removed according to a dihedron at 45° so that eight 45° connector members may be assembled on the cylindrical surface of the same connector member.

20. Construction set according to claim 1, wherein the different members further comprise an extendable adapter member, the extendable adapter member comprising a body having substantially the same shape as the adapter member and further comprising a protruding shaft having a length greater than the length of the shaft of the adapter member, the shaft of the extendable adapter member adapted to allow separation of the members which it joins.

21. Construction set according to claim 1, wherein the different members further comprise an extending connector member, the extending connector member comprising a body having substantially the same shape as the connector member and further comprising extending arms over at least one of its bases, the extending arms comprising a first end connected to the base of the extending connector member and a second end adapted to interact for assembly with the body of the adapter member or the extendable adapter member.

22. Construction set according to claim 1, wherein the different members further comprise an extendable panel member, the extendable panel member having substantially the shape of two panel members adapted to be joined by one of their ends so as to form a sliding surface in the plane constituted by said panel members.

23. Construction set according to claim 1, wherein the different members further comprise a sphere, the sphere comprising a body having a spherical surface adapted to interact for adjustable angular assembly with the ends of the adapter members and the extendable adapter members.

24. Construction set according to claim 1, the construction set further comprising a plurality of additional parts substantially taking on at a different scale the same functions and the same proportions as said members, the dimensions of said additional parts being established so that said additional parts interact with one another as well as with members at different scales, for assembly.

25. Construction set according to claim 12, wherein the thickness of the panel member and the width of the slots made in the radial projections of the connector members correspond to allow an assembly of the connector over the thickness of the panel member.

* * * * *